US006782572B1

(12) United States Patent
Jones

(10) Patent No.: US 6,782,572 B1
(45) Date of Patent: Aug. 31, 2004

(54) MULTI-USE PILLOW HAVING ADJUSTABLE POSITIONING FEATURES

(76) Inventor: Luther Eugene Jones, 7736 Widdecomb, Powell, TN (US) 37849

( * ) Notice: Subject to any disclaimer, the term of this patent is extended or adjusted under 35 U.S.C. 154(b) by 291 days.

(21) Appl. No.: 09/970,403

(22) Filed: Oct. 3, 2001

Related U.S. Application Data

(60) Provisional application No. 60/237,836, filed on Oct. 3, 2000.

(51) Int. Cl.[7] ..... A47G 9/00

(52) U.S. Cl. ..... 5/640; 5/636; 5/922; 297/397

(58) Field of Search ..... 5/636, 637, 640, 5/644, 922; 297/391, 397

(56) References Cited

U.S. PATENT DOCUMENTS 3,234,569 A * 2/1966 Stewart ..... 5/636
4,528,981 A * 7/1985 Behar ..... 5/922
5,056,533 A * 10/1991 Solano ..... 5/922
5,310,245 A * 5/1994 Lyszczasz ..... 5/655
5,581,832 A * 12/1996 Bridley ..... 5/655
5,785,388 A * 7/1998 Curtis ..... 5/922
D473,765 S * 9/2001 Kramer ..... D6/601

* cited by examiner

*Primary Examiner*—Alexander Grosz
(74) *Attorney, Agent, or Firm*—Pitts & Brittian, P.C.

(57) ABSTRACT

A multi-use pillow including a body member of generally cylindrical geometry having at least two elongated flat attachment strips, each preferably comprising a loop fastener material on one surface of the strip and having a smooth surface on the opposite side surface of the strip, and being attached to the outer surface of the body member with their respective loop-bearing surface exposed outwardly. At least one, and preferably two mounting straps, each having a first surface bearing a loop fastener material thereon, except for a short length of hook fastener material adjacent one end of the strap, and a second surface bearing a hook fastener material thereon, is anchored at one of its opposite ends to the body member at a location adjacent one of the opposite ends of the body member, with the remainder of the strap extending unsupported from the body member a distance that is equal to at least about the length of the body member, and preferably a multiple, preferably two to three multiples, of the length dimension of the elongated body member whereby the mounting strap is suitable for releasably mounting the pillow to a support such as the frame of a chair, etc.

5 Claims, 5 Drawing Sheets

MULTI-USE PILLOW HAVING ADJUSTABLE POSITIONING FEATURES

RELATED APPLICATIONS

This application is a non-provisional application which claims priority based on provisional application Ser. No. 60/237,836, filed Oct. 3, 2000, which provisional application is incorporated herein by reference.

FIELD OF INVENTION

This invention relates to body support cushions, particularly to pillows for support of the neck or back of a seated or reclining person.

BACKGROUND OF THE INVENTION commonly in the art, pillows are designed for a single use and therefore are provided with little or no means for securing the pillow in multiple positions on a variety of body support members such as a tanning bed, beach chair, lounge chair, motorcycle, or for use as an unsecured pillow for use on a beach towel, vehicle headrest, etc., for example.

SUMMARY OF THE INVENTION

The present invention comprises a multi-use pillow including a closed-end fabric body member of generally hollow cylindrical geometry filled with a resilient stuffing and having at least two elongated relatively narrow attachment strips, each comprising a loop fastener material on one surface of the strip and having a smooth surface on the opposite surface of the strip. The smooth surface of each attachment strip engages the outer surface of the fabric body member and is secured thereto, as by stitching, for example. A first flexible elongated mounting strap comprising a relatively narrow length of material bearing hook fastener material along substantially its entire length on one surface of the length of material and bearing loop fastener material along substantially its entire length on the opposite surface thereof, except for a short portion thereof is provided within one of its opposite ends anchored to a first one of the two attachment strips which encircle the girth of the cylindrical fabric body member. The remainder of this first mounting strap is unsupported. A second flexible elongated mounting strap of like construction as the first elongated mounting strap is provided within one of its opposite ends anchored to a second one of the two attachment strips which encircle the girth of the cylindrical fabric body member. The remainder of this second mounting strap is unsupported. Preferably that end of each mounting strap which is anchored to the fabric body member is anchored to the body member at a location employing one of the opposite ends of the body member such that the remainder of the strap extends unsupported from its respective end of the body member a distance that is equal to at least about the length of the body member, and preferably a multiple, preferably two to three multiples, of the length dimension of the cylindrical body member.

In one embodiment, the pillow of the present invention is provided with a third flexible elongated mounting strap which is affixed to the body member and extends along the length of the body member. The outwardly exposed surface of this third strap is provided with loop fastener material along substantially the full length of the strap.

DETAILED DESCRIPTION OF THE INVENTION

Figure 1:
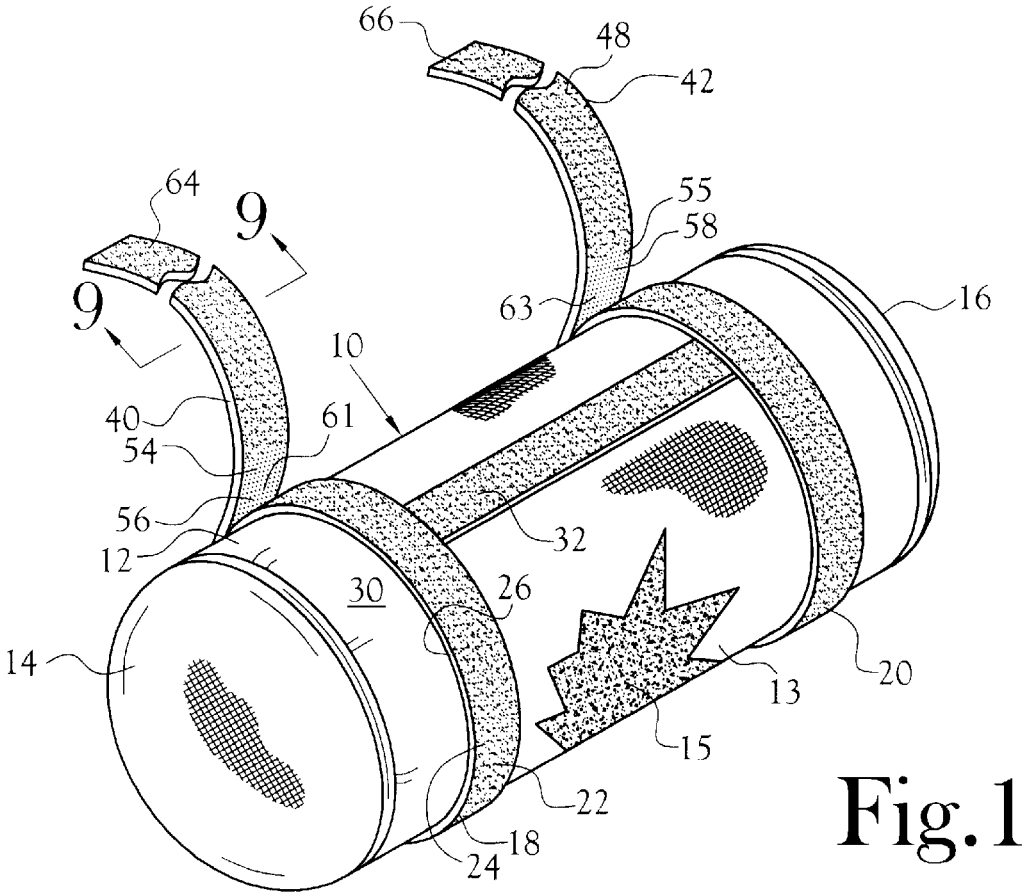
FIG. 1 is a representation of a pillow embodying various of the features of the present invention.
Figure 9:
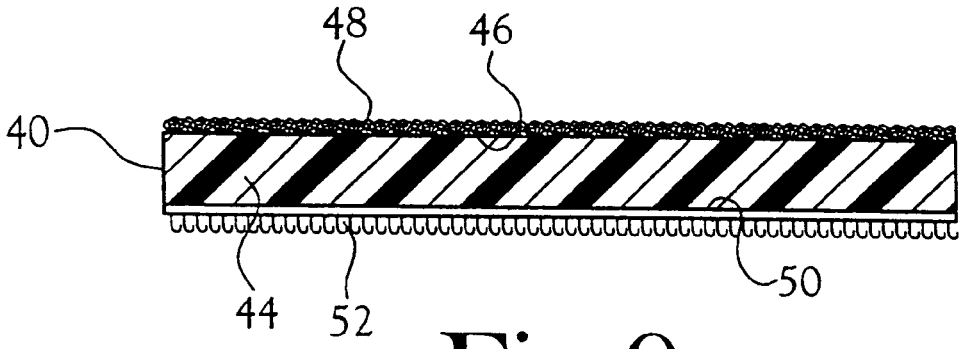

Referring initially to FIGS. 1, and 9, in accordance with one aspect of the present invention there is provided a multi-use pillow 10 comprising a fabric body member 12 of generally hollow cylindrical geometry having closed opposite ends 14,16 and being filled with a resilient stuffing 15. The body member of the present pillow is encircled about its girth at locations adjacent its opposite ends by at least first and second elongated relatively narrow attachment strips 18,20, each comprising a loop fastener material 22 on one surface 24 of the strip and having a smooth opposite surface 26. The smooth surface of each attachment strip engages the outer surface 30 of the fabric body member 12 and is secured thereto, as by stitching, or by an adhesive, for example. As desired, additional strips of loop fastener material may be provided in encircling relationship to the body member or extending along the length of the body member to provide additional locations for the attachment of the [distall] ends of the mounting straps 40,42 to the body member. Each of the first and second mounting straps 40,42 includes a first end 56,58 and an opposite second end 64,66, respectively.

In the present invention, the preferred body member 12 includes an outer fabric cover 13 which fully encapsulates a resilient material, such as soft foam or fibrous material, such as a tangled mass of 100% nylon fibers, internally of the outer cover. This outer cover 13 preferably is of a liquid-proof or liquid-resistant material or a fabric material 15 which has been treated to make it liquid-proof or liquid-resistant, for example 100% polyester woven fibers, preferably which have been treated to render the resultant woven fabric liquid-proof or liquid-resistant. For present purposes, "liquid-proof" and "liquid-resistant" are intended to convey the concept of preventing or at least resisting the movement of a liquid, such as body oils or water into and/or through the outer cover material and/or transfer of material quantities of such liquids through the outer cover material into the interior of the body member. By this means, the present pillow is designed to permit its repeated use as a tanning bed pillow or a beach pillow where it is exposed to body oils, either natural or extraneous oils, human perspiration, etc., in that the liquid remains on the exterior of the pillow and may be wiped away with a dry towel or a towel or the like which has been wetted with a soap solution, a disinfectant, or the like, all without detriment to the pillow. This feature of the present invention provides for repeated use of the same pillow by multiple persons without concern for transfer of contaminants from one user to a subsequent user of the pillow. Moreover, this feature provides for an extended useful life of the pillow by protecting it from deterioration and/or prevention of the accumulation of foul odor by reason of accumulation of liquids either within the outer cover material or interiorly of the pillow.

Figure 2:
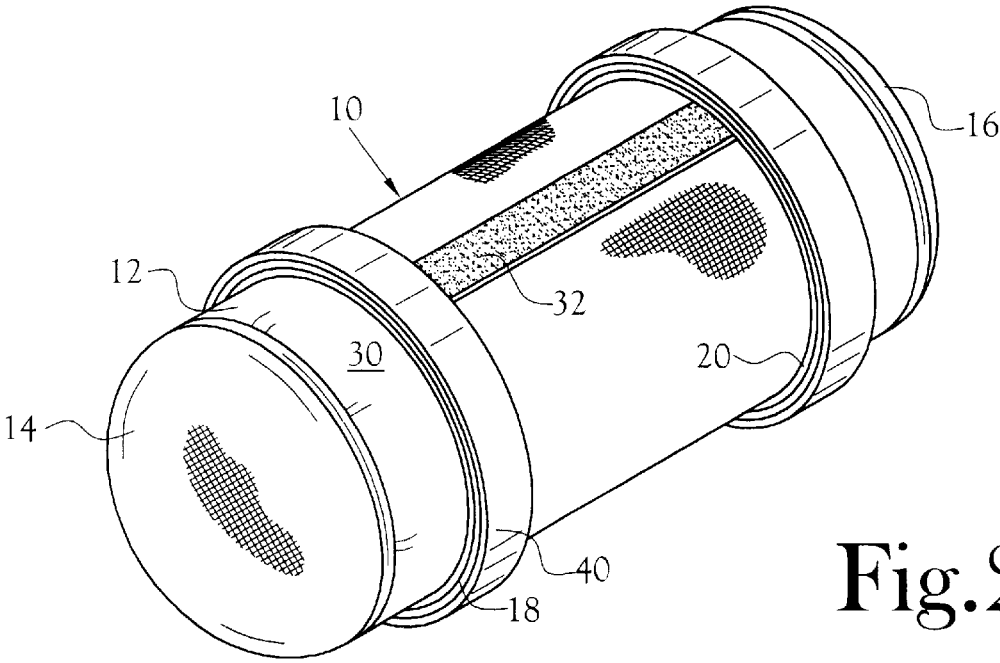
FIG. 2 is a representation of the pillow of FIG. 1 and depicting one embodiment of the mounting straps thereof in encircling stored relationship about the attachment strips secured to the body member of the pillow.
Figure 3:
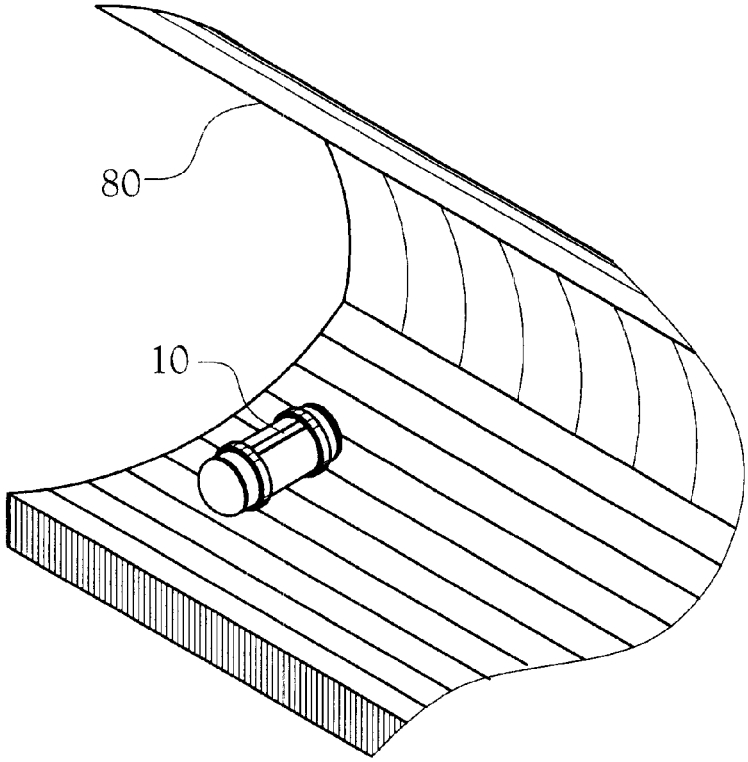
FIG. 3 is a representation of the pillow of FIG. 1 and depicting the pillow as employed with a tanning bed.
Figure 4:
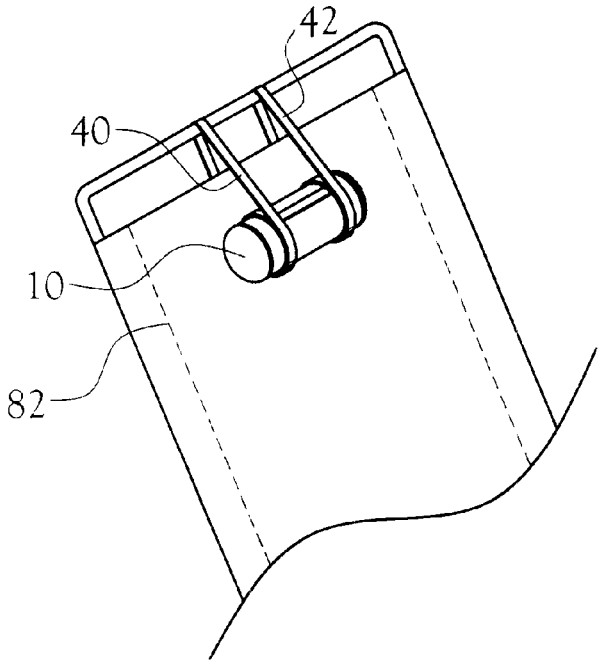
FIG. 4 is a representation of the pillow of FIG. 1 and depicting the pillow as employed with a beach or lounge chair.
Figure 5:
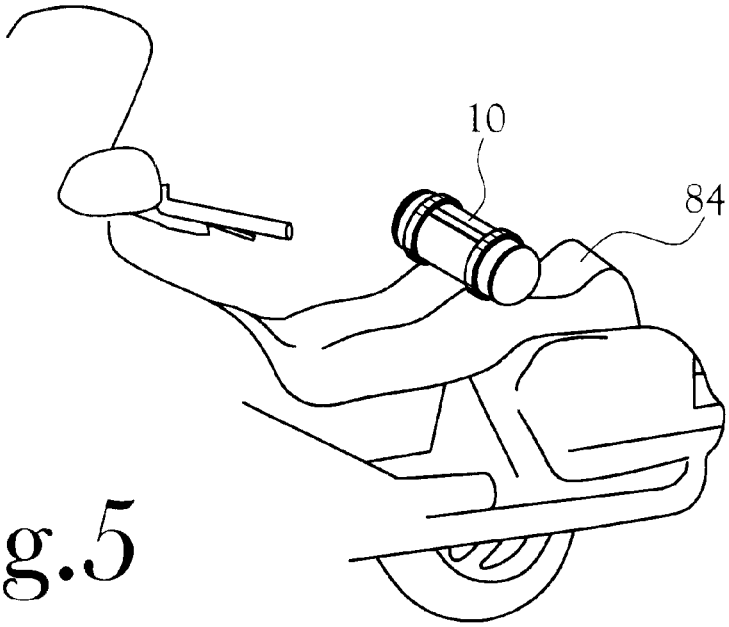
FIG. 5 is a representation of the pillow of FIG. 1 and depicting the pillow mounted on a motorcycle as a back support for the rider.

As seen in FIGS. 1 and 2, the body member 12 further optionally includes at least one third strip of loop material 32 attached to the outer surface 30 of the body member and extending substantially between the girth-encircling attachment strips adjacent the opposite ends 14,16 of the body member. Preferably, this third strip of loop material 32 is aligned generally parallel to the length dimension of the body member and provides a locus of attachment of each of the elongated mounting straps 40,42, as desired.

Referring particularly to FIGS. 1,2, and 9, the pillow of the present invention includes first and second elongated mounting straps 40,42, each of which comprises a length of a flat, narrow, preferably polymeric, base material 44 having first and second opposite surfaces 50,46. The surface 50 of the base material is provided with a hook fastener material 52 along substantially its entire length. The opposite surface 46 of the base material is provided with loop fastener material 48 along substantially its entire length, except for a short portion 54 of the base material (see FIG. 1) that is adjacent the respective locus of attachment of the respective ends 56,58 of the straps 40,42 to repective ones of the girth-encircling attachment strips 18,20 or to the body member 12 at some location other than a girth-encircling strip. This hook fastener material on that end of a mounting strap which is releasably anchored to the body member enhances the ease of anchoring and/or release of this end of the mounting strap to the body member and further precludes undesired interlocking of the unsupported end of each mounting strap with a respective one of the girth-encircling loop-bearing strips in the course of the manufacture of the pillow and in the course of the end use of the pillow.

Each of the two mounting straps 40,42 is fabricated from a flexible, liquid-proof material which is washable, such as a polymeric material. Each of these straps extends unsupported from its locus of anchoring to the body member a distance which is at least greater than about the length of the body member and preferably a distance which is at least multiple, and preferably two or three multiples of the length of the body portion 12 of the pillow. The extended length of each strap is unsupported and therefore available for mounting of the pillow to a support, such as the frame of a chair, motorcycle, or a large variety of other applications, such as depicted in FIGS. 3–8. Commonly, mounting of a pillow includes extension of the mounting straps from the body member, wrapping of these straps about a frame member of a chair, etc., and return of the straps to the body member whereupon the hook fastener material on or near the distal ends of the straps is interlocked with the loop material of either the girth-encircling attachment strips or the attachment strip which extends along the length of the body member. For storage of one or both of the mounting straps when the pillow is to be in storage between uses or one of the straps is not needed for mounting of the pillow, each mounting strap 40,42 may be wound about its associated girth-encircling attachment strip with its hook-bearing surface overlying the loop-bearing surface of its respective attachment strip during a first wrap of the girth of the body member and with the hook bearing surface of the mounting strap facing and interlocking with its own loop-bearing surface upon subsequent wraps about the girth of the body member (see FIG. 2).

Notably, the attachment strips of loop-bearing material 18,20 which encircle the girth of the body member, the strip of loop-bearing material 32 which extends along the length of the body member, and the mounting straps 40,42 of hook/loop-bearing material may each be formed of a synthetic fibrous material, e.g. woven nylon fibers, hence is substantially non-absorptive of liquids of the type to which the pillow is likely to be exposed in the course of its intended use and which is washable. Because the at least two elongated mounting straps 40,42 which are designed to releasably secure the pillow to a support device such as a lounge chair, for example, are commonly not in physical contact with a user of the pillow, there is no material detrimental absorption of liquid by these straps, but like the other materials of the present pillow, they are washable.

By reason of the choice of length of the mounting straps 40,42 and their material of construction, in cooperation with the strips of loop material 18,20, and 32 attached to the outer surface of the body member of the pillow, the present pillow may be releaseably secured to a variety of body-support devices, such as tanning beds 80 (FIG. 3), beach chairs 82 (FIG. 4), motorcycle seats 84 (FIG. 5), lounge chairs 86 of most any design (FIG. 6), head rests in motor vehicles 88 (FIG. 7.) and head or back supports in a variety of environments such as outdoor camping, medical care facilities, etc. (FIG. 8), for example. Alternatively, as seen in FIGS. 2,3,7, and 8 the mounting straps 40,42 may be merely wrapped about the outer circumference of the pillow and their distal ends 64,66 releasably secured to either of the girth-encircling strips 18,20 of loop-bearing material, or to the longitudinal strip of loop material 32 which extends longitudinally of the body member. In various applications, the pillow may be used merely as a movable, e.g., freely positionable, pillow, such as when using the pillow in combination with a beach towel laid out on a beach, as a neck support in a motor vehicle, or like applications.

In one specific embodiment of the pillow of the present invention, the body member 12 of the pillow is a fabric cylinder of a straight cylindrical geometry having a length of about 16 inches and a girth of about 15 inches. The fabric cylinder is substantially filled with a tangled mass of nylon or other liquid repellant polymeric fibers. Each of the girth-encircling attachment strips is about three-fourths inch wide and about 15 inches in length and is secured to the outer surface of the body member adjacent a respective end of the body member, preferably about 1 inch inwardly from the respective end of the body member. Further, the two mounting straps 40,42 suitably are each about three-fourths inch wide, about 25 inches in length. One end of each mounting strap is anchored at respective locations adjacent a respective one of the opposite ends of the body member, either removably attached to a girth-encircling strip or being fixedly attached to a girth-encircling strip or directly to the body member 12.

It will be recognized by one skilled in the art that various materials of construction may be selected to provide the physical and structural features of the present pillow. For example, the cover of the body member may comprise a loop material which is suitable for the releasable attachment thereto of the hook fastening material of the mounting straps. Moreover, the pillow of the present invention may assume a geometry and/or dimensions, other than a straight cylindrical geometry, even though the geometry depicted in the accompanying drawings and described in the present specifications is preferred. Clearly, the dimensions of the pillow may be varied to suit a particular application, but advantageously, the present inventor has found that "one size" pillow is most suitable for a very large variety of uses.

By reason of its materials of construction, the present pillow is washable and is dryer compatible.

Figure 6:
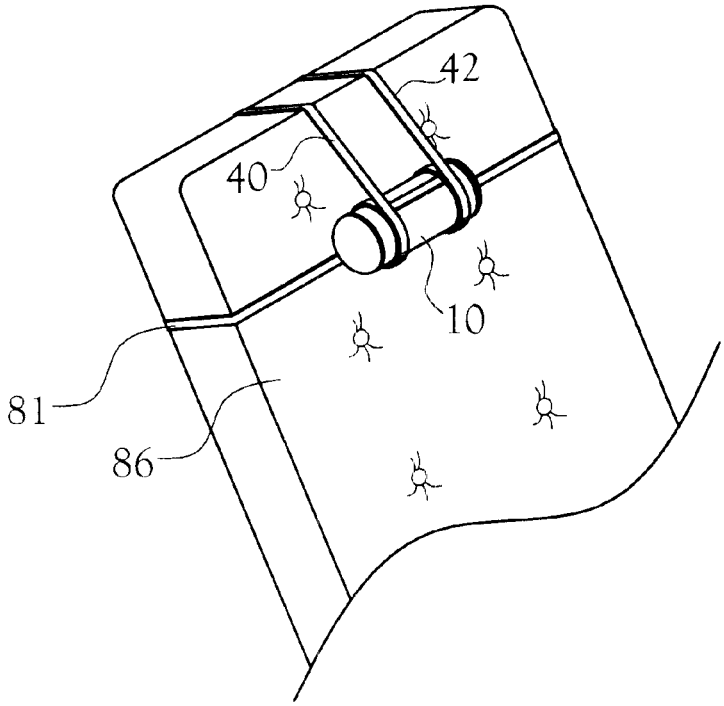
FIG. 6 is a representation of the pillow of FIG. 1 and depicting the pillow as mounted on the upright back of a recliner or other hi-back chair.
Figure 7:
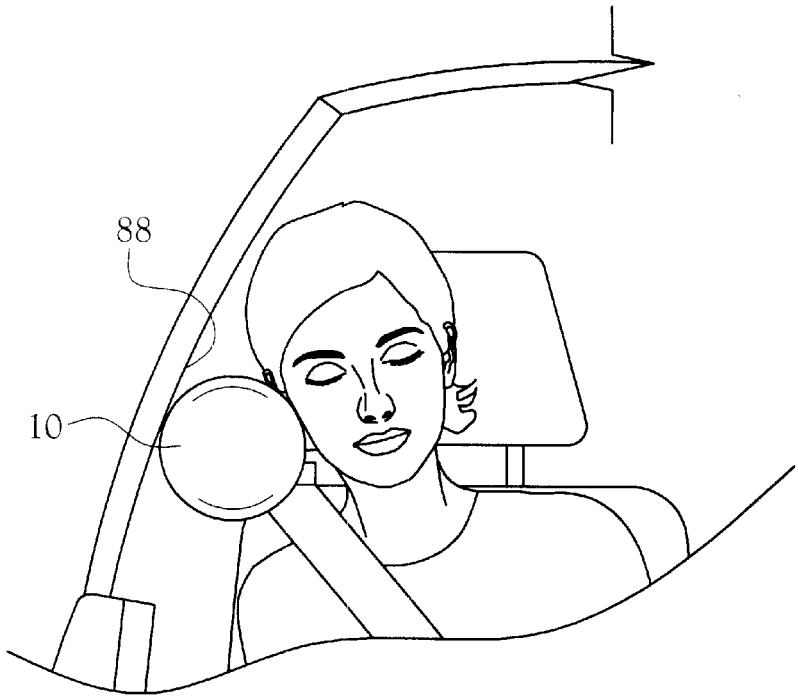
FIG. 7 is a representation of the pillow of FIG. 1 and depicting the pillow as employed as a headrest for a passenger in a motor vehicle.
Figure 8:
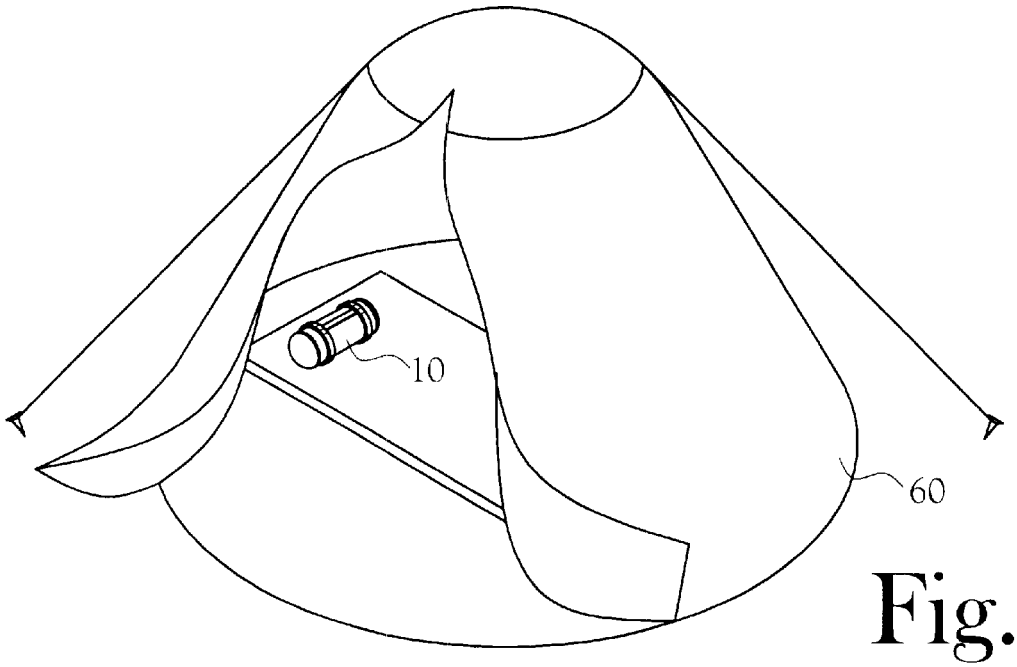
FIG. 8 is a representation of the pillow of FIG. 1 and depicting the pillow as employed as a neck and/or back support in various environments, such as a camping environment; and, FIG. 9 is a cross-sectional view taken generally along the line 9—9 of FIG. 1.

In a further embodiment of the present invention, there may be provided a detached mounting strap 81 of a length sufficient to encircle the upright back rest of a lounge chair such as depicted in FIG. 6, for example, to provide further means for releaseably securing the present pillow to a lounge chair back rest or other support. In this embodiment, the strap 81 which encircles the back rest of the chair comprises a flat base material having loop fastener material on substantially the entire length of one surface thereof and a hook fastener material on only one end portion of the opposite surface of the base material whereby the strap may be releaseably secured to any one of those straps that are affixed to the body member and/or to the girth-encircling strips of loop material on the body member of the pillow.

Having thus described the aforementioned invention, I claim:

1. A pillow for removable attachment to a support comprising a generally hollow fabric cylinder having first and second opposite closed ends, resilient stuffing contained within the substantially filling said fabric cylinder, at least first and second attachment strips, each of said attachment strips including an outwardly exposed flat surface defined by loop fastener material, each of said attachment strips being secured around the girth of said fabric cylinder at respective locations adjacent opposite ends of said fabric cylinder with said loop fastener material thereof being exposed outwardly of said fabric cylinder, a further attachment strip secured to said fabric cylinder, said further attachment strip including loop fastener material exposed on an outer surface thereof and extending between said first and second attachment strips secured around the girth of said fabric cylinder, at least first and second elongated mounting straps, each of said mounting straps including first and second opposite ends, and first and second opposite surfaces, a first one of said surfaces of each of said mounting straps being defined by loop fastener material extending over substantially the entire length of first surface of said mounting strap except for a short length of hook fastener material disposed at one end of each of said mounting straps, a second one of said surfaces of each of said mounting straps being defined by hook fastener material extending over substantially the entire length of said second opposite surface of each of said mounting straps, each of said mounting straps being releasably attached to respective ones of said attachment strips, which are affixed to said body member by means of releasable interlocking engagement between said short length of hook fastener material disposed on said one end of said mounting straps with said loop fastener material of at least one of said attachment strips and with the remainder of each of said mounting straps extending unsupported from said body member.

2. The pillow of claim 1 wherein each of said first and second mounting straps is of a length which is a multiple of the length of said fabric cylinder.

3. The pillow of claim 1 wherein each of the elements of the cushion are at least liquid repellant.

4. The pillow of claim 1 wherein each of the elements of the cushion is washable.

5. The pillow of claim 1 wherein said resilient stuffing comprises a tangled mass of polymeric fibers.

* * * * *